US005405071A

United States Patent [19]

Baugus

[11] Patent Number: 5,405,071

[45] Date of Patent: Apr. 11, 1995

[54] NAIL GUN HEAD ELEVATING TOOL

[76] Inventor: Michael Baugus, 1338 San Miguel, Santa Barbara, Calif. 93109

[21] Appl. No.: 111,971

[22] Filed: Aug. 24, 1993

[51] Int. Cl.[6] ..... B27F 7/02

[52] U.S. Cl. ..... 227/140; 227/156

[58] Field of Search ..... 227/140, 151, 152, 8, 227/130, 156; 411/395; 16/DIG. 37; 173/115

[56] References Cited

U.S. PATENT DOCUMENTS

| | | | |
|---|---|---|---|
| 827,230 | 7/1906 | Goeppinger | 411/395 |
| 1,401,444 | 12/1921 | Roberts | 411/395 |
| 1,973,170 | 9/1934 | Jacobi | 411/395 |
| 2,004,398 | 6/1935 | Steenson | 411/395 |
| 2,220,195 | 11/1940 | Amundsen | 173/115 |
| 2,228,915 | 1/1941 | Rosenmund . | |
| 2,759,184 | 8/1956 | Wood | 227/140 |
| 3,074,069 | 1/1963 | Conrad . | |
| 3,670,941 | 6/1972 | Grinnell et al. . | |
| 3,820,705 | 6/1974 | Beals . | |
| 3,880,339 | 4/1975 | Bone . | |
| 4,085,882 | 4/1978 | Stamper . | |
| 4,778,094 | 10/1988 | Fishback | 227/140 |
| 4,821,937 | 4/1989 | Rafferty | 227/8 |
| 5,074,453 | 12/1991 | Tachihara et al. | 227/130 |
| 5,201,449 | 4/1993 | Miller . | |

FOREIGN PATENT DOCUMENTS

| | | | |
|---|---|---|---|
| 50609 | 11/1911 | Austria . | |
| 0218565 | 8/1990 | Japan | 173/115 |

*Primary Examiner*—Eugenia Jones
*Assistant Examiner*—Allan M. Schrock
*Attorney, Agent, or Firm*—John P. O'Banion

[57] ABSTRACT

A pneumatic nail gun head elevating tool (10) for varying the depth to which a nail (50) can be driven is disclosed. The tool (10) includes a generally cylindrical base member (24) having means for coupling to a push lever (14) or firing head (20) of a nail gun (12), to which a generally cylindrical adjustment knob member (22) is rotatably coupled. Rotation of adjustment knob member (22) causes adjustment knob member (22) to extend or retraction in relation to base member (24) thereby controlling the depth of penetration of the nail (50) ejected from the nail gun (12).

12 Claims, 3 Drawing Sheets

NAIL GUN HEAD ELEVATING TOOL

BACKGROUND OF THE INVENTION

1. Field of the Invention

This invention pertains to construction tools generally, and more specifically to a tool for selectively elevating the head of a pneumatic nail gun above a nailing surface, thereby varying the penetration depth of a nail being driven into the nailing surface.

2. Description of the Background Art

Pneumatic nail guns have been in use for a number of years, primarily in the building trades, where applications require driving hundreds or thousands of nails per day. The pneumatic nail gun has resulted in the saving of time and energy required for driving the large numbers of nails typical in industrial applications.

It is often desirable when using a pneumatic nail gun to drive nails to varying depths, especially, for example, when the surface in which a nail is to be driven overlies a second surface which is easily damaged by nails, or else where the second surface is impervious to nails. Additionally, it may be desirable to be able to vary the penetration depth of a nail when a user wishes to tack an article to a surface, temporarily. A nail driven to a shallow depth more readily accomplishes these ends than a deeply driven nail.

In normal operation, a user places the end of a pneumatic nail gun head flush with the nailing surface. A pneumatically operated drive bit inside the nail gun drives the nail head flush with the end of the nail gun head and the nailing surface. The drive bit is operated by a trigger or like device to "fire" the nail gun.

Alternatively, safety awareness in recent years has regulated the mandatory addition of a safety device known as a "push lever". The push lever safety device generally includes a slidable safety head which partially surrounds the firing head of the nail, and further includes an arm extending outward from the safety head along the exterior surface of the firing head to communicate with a drive bit operating mechanism.

Prior to operation, the end of the push lever overlaps and extends beyond the outlet of the firing head of the nail gun. For single nailing, the user presses the push lever against the surface to be nailed and pulls the trigger of the nail gun. For continuous nailing, the use pulls the trigger first and then "bounces" the push lever along various points of the surface to be nailed. In either manner, at the point of firing the end of the push lever and the end of the firing head are substantially aligned and the push lever is in contact with the drive bit operating mechanism.

The addition of the push lever therefore requires the user to undergo a two-step procedure to fire a nail gun: (1) depress the trigger and (2) press the press the push lever against the nailing surface. The push lever therefore insures that the nail gun will only be fired when the firing head of the nail gun head contacts the surface to be nailed. Hence, a push lever equipped nail gun will never fire in mid-air, where a propelled nail could travel and cause unwanted damage or human injury.

In the past, when pneumatic nail guns were not equipped with push levers it was found that by elevating the end of the nail gun head above the nailing surface, the depth of penetration of a nail could be varied. Because this lead to instability of the nail gun and lack of control over the depth of penetration of the nail, fixed length spacer devices were developed for elevating the nail gun head above the nailing surface. Slidably adjustable spacers were also developed but required use of a wrench or screwdriver for adjustment.

Furthermore, prior devices have failed to provide a nail gun head elevating tool which adapts to push lever equipped nail guns. Given that regulations in many locations require that nail guns be equipped with push lever safety devices, a need exists for a nail gun head elevating tool which can be used with push lever equipped nail guns.

The present invention overcomes the deficiencies of the prior devices by eliminating the need for an additional tool, such as a wrench, to accomplish the function of varying nail penetration depth. Additionally, the present invention is specifically designed to adapt to any model of pneumatic nail gun head, whether equipped with a push lever safety device, or not.

The foregoing information reflects the state of the art of which the applicant is aware and is tendered with the view toward discharging applicant's acknowledged duty of candor in disclosing information which may be pertinent in the examination of this application. It is respectfully stipulated, however, that the information disclosed herein does not teach or render obvious either singly, or when considered in combination, applicant's claimed invention.

SUMMARY OF THE INVENTION

The present invention generally pertains to a removable device having an easy to use, finger-adjustable design for readily varying the penetration depth of nails exiting from a pneumatic nail gun. By way of example and not of limitation, the present invention includes a cylindrically-shaped base member configured for coupling to the push lever of a nail gun, and a cylindrically-shaped adjustment knob member threadably coupled to the base member. It should be noted, however, that the present invention can be coupled directly to the firing head of a nail gun not having a push lever in the same manner described herein.

The adjustment knob has threads placed upon its inner surface and the base has threads placed upon its outer surface, thus allowing the two members to threadably engage each other and couple in a rotatable, screw-type manner. Additionally, the adjustment knob has a textured outer surface for allowing a user to obtain an adequate finger grip for rotating the adjustment knob about the base. It is the finger-adjustable design of this invention which allows it to operate without ancillary tools.

Both the adjustment knob and base members include a slot extending from end to end for allowing the unobstructed passage of nails from a nail magazine attached to the side of a nail gun on which the present invention is being used. It is important that the slots present in the adjustment knob and base members be aligned to allow the passage of a nail from the nail magazine.

The base member is detachably coupled to the push lever of the nail gun and remains in place during use. The base member preferably includes an inside surface which is shaped to form-fit around the end of the push lever of the nail gun. This form-fitting quality of the base member insures that the base member will communicate closely with the push lever to provide for stability. Additionally, a plurality of variable coupling features may be added to the base member for more securely coupling the base member to any one of a variety of designs of push levers.

When the adjustment knob member is coupled to the base member, the slot placed in the base member allows the base member to partially compress, thus further tightening the inside member around the push lever. The threadable engagement of the adjustment knob member upon the base member allows the adjustment knob member to move in a longitudinal direction upon being rotated about the base member. The base member thus remains fixed upon the push lever, while the adjustment knob member moves longitudinally, from end to end, in relation to the base member.

Longitudinal movement of the adjustment knob member in one direction is limited by an annular lip located at one end of the adjustment knob member. When the adjustment knob member is rotated to a point where the corresponding ends of the adjustment knob member and the base member are aligned (e.g., no extension), the lip will abut against an annular ridge at one end of the base member, thus preventing further travel of the adjustment knob.

By rotating the adjustment knob member, the adjustment knob member can be retracted or extended in relation to the base member and, therefore, the push lever and firing head. By extending the adjustment knob member, the firing head can be elevated above the surface to be nailed. Upon pressing the end of the adjustment knob member against the nailing surface, the push lever will move into its firing position, at which point the outer end of the push lever with be substantially aligned with the end of the firing head. However, the adjustment knob member, by extending away from the push lever, will likewise extend away from the firing head, thus holding the firing head away from the nailing surface at a specified distance at the point of firing, and thereby varying the depth of penetration of any subsequently driven nails.

On a nail gun which does not have a push lever, the present invention couples directly around the nail gun head and thus upon rotating the adjustment knob member to an extended position, the adjustment knob member directly elevates the nail gun head above the nailing surface, thus varying the penetration depth of any subsequently driven nails.

Removing the present invention from a nail gun equipped with a push lever is easily accomplished by preferably unscrewing the adjustment knob member from the base member, thus releasing the base member from its compressed state around the push lever. Upon releasing the base member from its compressed state, normal pulling pressure is sufficient to remove the base member from the push lever. On a nail gun absent a push lever, the same steps of removing the adjustment knob member from the base member previously described, must be undertaken. The base member may then be pulled from the nail gun head.

An object of the invention is to provide a simple device for adjusting the depth of a penetrating nail deposited from a pneumatic nail gun.

Another object of the invention is to provide a nail gun head elevating tool which is finger-adjustable.

Another object of the invention is to provide a nail gun head elevating tool which can be adapted to pneumatic nail guns incorporating a push lever safety device.

Another object of the invention is to provide a nail gun head elevating tool which fixedly couples around a nail gun head or around the push lever of a nail gun in a form-fitting manner.

Another object of the invention is to provide a nail gun head elevating tool which automatically aligns itself 90 degrees to a nailing surface.

Still another object of the invention is to provide a nail gun head elevating tool which can be readily detached from a nail gun head or push lever without the use of ancillary tools.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes, the present invention is embodied in the apparatus generally shown in FIG. 1 through FIG. 6. It will be appreciated that the apparatus may vary as to configuration and as to details of the parts without departing from the basic concepts as disclosed herein.

Figure 1:
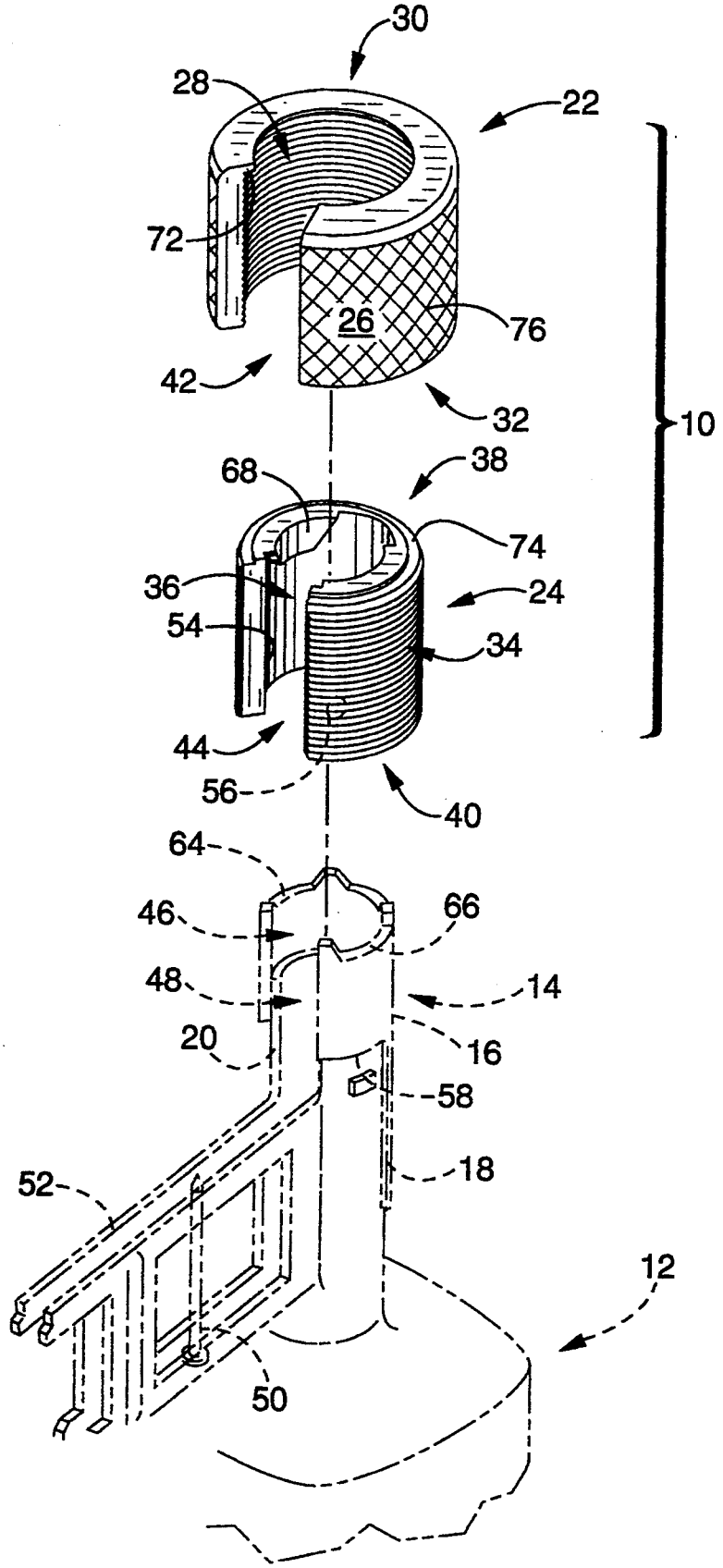
FIG. 1 is an exploded view of the apparatus of the present invention further exploded from a push-lever equipped nail gun shown in phantom.

Referring to FIG. 1, a nail gun head elevating tool 10 in accordance with the present invention is generally shown configured for coupling to a pneumatic nail gun 12 which employs a push lever 14 as a safety device. In such a nail gun, push lever 16 incudes a safety head 18, as well as a control arm 20. This particular configuration of nail gun 12 conforms to that of a Hitachi Model NR83A which is representative of a typical pneumatic nail gun employing a push lever. It should be noted, however, that the apparatus 10 of the present invention may be used on nail guns which do not have a push lever 14 by directly coupling the apparatus to the firing head 20.

Figure 2:
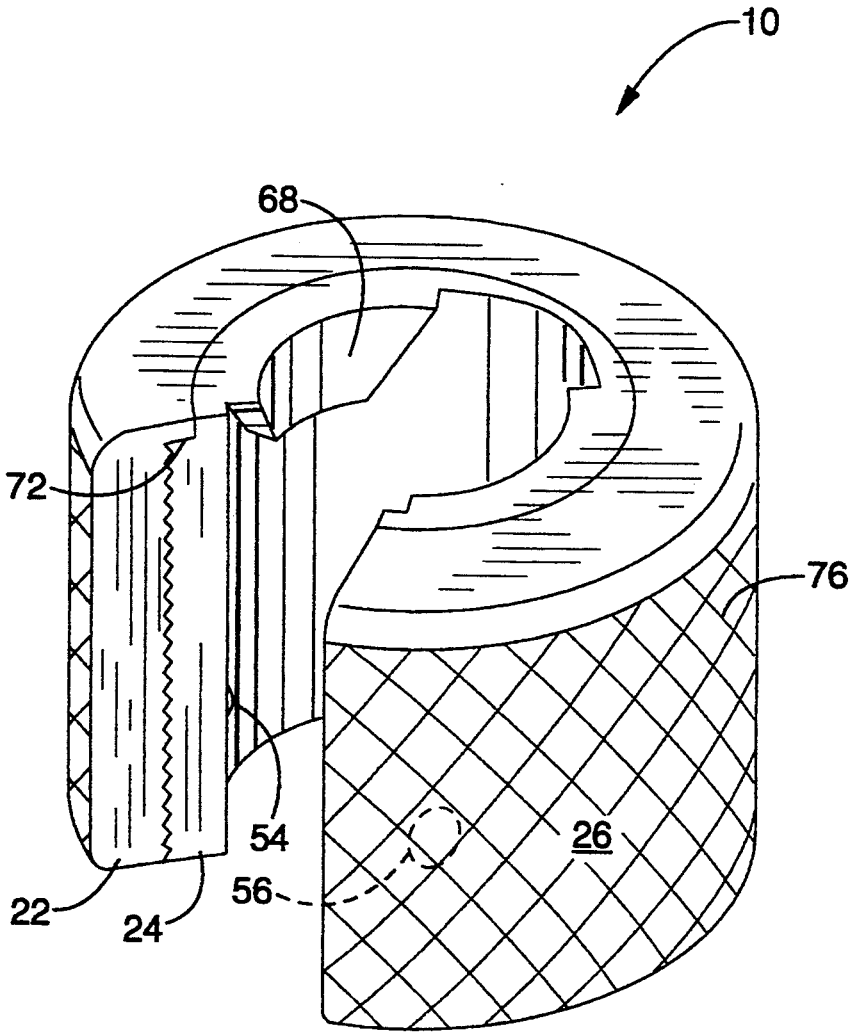
FIG. 2 is an assembled perspective view of the apparatus of the present invention shown in a fully retracted position.

Referring also to FIG. 2, the nail gun head elevating tool 10 of the present invention includes an adjustment knob member 22 and a base member 24, both of which are generally cylindrical in shape. However, other shapes can be used without departing from the invention herein. Adjustment knob member 22 includes an outer surface 26, a threaded cavity 28, an upper end 30 and a lower end 32. Base member 24 includes a threaded outer surface 34, a cavity 36, an upper end 38, and a lower end 40. In the preferred embodiment, the shape of cavity 36 conforms to the shape of safety head 16 to provide for tight engagement when placed thereon and, therefore, the shape of cavity 36 can vary.

Adjustment knob member 22 includes a slot 42 which extends longitudinally between upper end 30 and lower end 32 and provides an opening between outer surface 26 and threaded cavity 28. Similarly, base member 24 includes a slot 44 which extends longitudinally between upper end 38 and lower end 40 and provides an opening between threaded outer surface 34 and cavity 36. When the apparatus is installed on nail gun 12, slots 42, 44 are aligned with slots 46, 48 found in safety head 16 and firing head 20, respectively, of nail gun 12. In this manner, a nail 50 from nail magazine 52 can enter firing head 20 without obstruction from the apparatus.

Base member 24 also includes snap grips 54, 56 which are generally convex, rounded projections in cavity 36. In use, snap grips 54, 56 fit over and adjacent to ledge 58 in safety head 16 to prevent base member 24 from being disengaged from push lever 14. When base member 24 is installed, slot 44 is spread apart so that snap grips 54, 56 slide over safety head 16 and, once in place, the natural resilience of base member 24 causes snap grips 54, 56 to snap into place. Other forms of attachment could be used, such as set screws or the like, provided that base member 24 can be easily detached when removal or replacement of the apparatus is desired.

In the preferred embodiment, adjustment knob member 22 is rotatably coupled to base member 24 by threading adjustment knob member onto base member 24. In this manner, threaded outer surface 34 engages threaded cavity 28. Alternatively, adjustment knob member 22 and base member 24 could be coupled using a non-threaded engagement which allows rotational motion and permits the axial position between the two members to be adjusted. Preferably, however, threads are used and the threads engage in tight-fitting manner which prevents rotation motion during normal use, but not so tight as to prevent adjustment knob member 22 from being rotated upon applying normal finger pressure.

Referring to FIG. 1 through FIG. 4, base member 24 is characterized as being configured for coupling to any safety head 16 or firing head 20. These characteristics divided into two categories: (1) standard coupling features incorporated into every base member 24 and (2) variable coupling features incorporated into specific versions of base member 24 which are designed to couple base member 24 to specific models of nail guns.

The standard coupling features incorporated into every base 24 include compressibility of base member 24 when coupled to adjustment knob member 22, and "form-fitting" wherein cavity 36 is sized to compress against safety head 16 even when adjustment knob 22 is removed. These compressibility and form-fit features insure that the maximal amount of surface contact between cavity 36 and safety head 16 occurs, thus insuring firm engagement of base member 24 to push lever 14.

In the preferred embodiment the sidewalls 60, 62 (FIG. 3) of base member 24 converge slightly so that, in order to install base member 24 over safety head 16, it is necessary to spread sidewalls 60, 62 apart slightly. In other words, the inside diameter of cavity 36 is slightly smaller than the outside diameter of safety head 16 when base member 24 is not coupled to safety head 16. When installed, base member 24 thereby "clamps" around safety head 16. This clamping force is increased when adjustment knob member 22 is coupled to base member 24 due to the compressibility of base member 24.

Compressibility of base member 24 results from the use of a resilient material such as plastic or the like, as well as the inclusion of slot 44. The outer diameter of base member 24 is sized such that, when coupled to adjustment knob member 22, base member 24 compresses slightly and the width of slot 44 narrows in relation to that when uncoupled from adjustment knob 22.

The variable coupling features incorporated into base member 24 provide further insurance that base member 24 will not rotate when coupled to push lever 14 and placed in normal use. These features are specific to each different design of safety head 16, and are intended to match the contours and surface anomalies specific to a particular design of push lever 14, thereby further holding inside member 24 in place. No limits are placed on the design or placement of the variable coupling features and therefore the variable coupling features may take any shape or form practical for fixedly coupling base member 24 to push lever 14.

Figure 3:
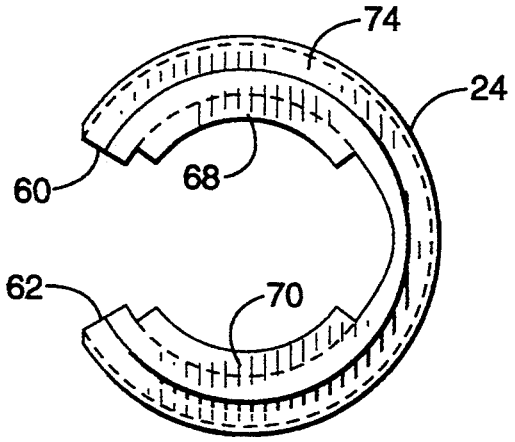
FIG. 3 is a top plan view of the base member portion of the apparatus shown in FIG. 1.
Figure 4:
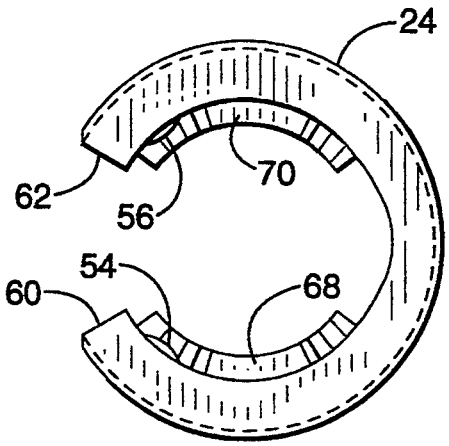
FIG. 4 is a bottom plan view of the base member portion of the apparatus shown in FIG. 1.
Figure 5:
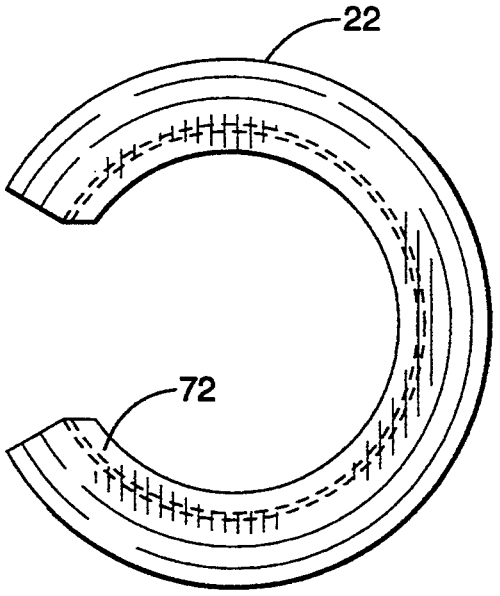
FIG. 5 is a top plan view of the adjustment knob portion the apparatus shown in FIG. 1.
Figure 6:
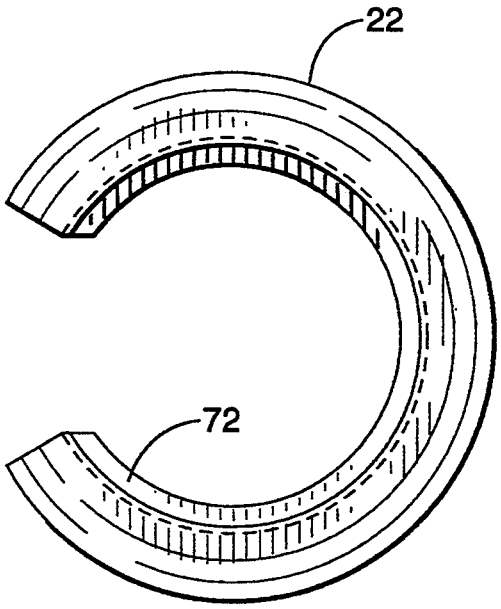
FIG. 6 is a bottom plan view of the adjustment knob portion of the apparatus shown in FIG. 1.

For example, referring again to FIG. 1, a nail gun 12 is shown having a specific design of push lever 14 attached thereto, including safety head 16 and control arm 18. Safety head 16 surrounds firing head 20 and control arm 18 extends outward from safety head 16. Safety head 16 has a plurality of edgewise indentations 64, 68 and a ledge 58 extending circumferentially around firing head 20. Referring also to FIG. 2 through FIG. 4, it can be seen that the contours of safety head 16, particularly the contours provided by edgewise indentations 64, 66 and ledge 58, provide specific mating surfaces to which base member 24 can be coupled. For fitting with this particular configuration of push lever, base member 24 includes a plurality of keys 68, 70 extending from upper end 38 into cavity 36. These keys mate with edgewise indentations 64, 66 to prevent base member from undergoing any unwanted rotation motion. Alternatively, set screws or the like extending through base member 24 and into holes or recesses in safety head 16 could be used. Similarly, snap grips 54, 56 described earlier fit over and adjacent to ledge 58 to prevent axial motion of base member 24, and can be replaced with other means for coupling base member 24 to a specific push lever 14.

The standard coupling features are designed to work in conjunction with the variable coupling features for fixedly coupling base member 24 to push lever 16. For example, snap grips 54, 56 are designed to work in conjunction with the compressibility feature of base member 24, in that upon sliding base member 24 over safety head 16, snap grips 54, 56 snap over ledge 58 a defined distance sufficient to prevent base member 24 from being falling off of push lever 14. Upon coupling adjustment knob member 22 to base member 24, base member 24 will compress slightly, thereby compressing snap grips 54, 56 further inward an additional distance, thereby further securing base member 24 to firing head 20.

While the standard coupling features in cooperation with the variable coupling features provide means for coupling base member 24 to push lever 14, adjustment knob member 22 is free to rotatably travel along base member 24 in a lengthwise direction for extension and retraction of the apparatus. However, referring also to FIG. 5 and FIG. 6, the retracted travel of adjustment knob member 22 is preferably limited by an annular lip 72 which extends from the upper end 30 of adjustment knob 24, and by an annular shoulder 74 at the upper end 38 of base member 24. In the preferred embodiment, lip 72 will overlap and abut shoulder 74 when adjustment knob member 22 and base member 24 are rotated into a fully retracted position. In this matter, the ends 30, 38 will be aligned to form a generally planar surface. When the apparatus is in a fully retracted position, a nail 50 may to be driven to maximum depth.

Alternatively, as adjustment knob member is rotated away from the nail gun, the length of the apparatus increases and the subsequent penetration of any nail 50 becomes incrementally shallower. The shallowest penetration is achieved when lower end 32 of adjustment knob member 22 approaches alignment with upper end 38 of base member 24. At this point, firing head 20 is elevated to a maximum height above the nailing surface and any subsequently driven nails 50 experience the shallowest depth of penetration.

The nail gun head elevating tool 10 of the present invention requires only the user's fingers to rotate adjustment knob member 22 about base member 24 until the desired adjustment is achieved. To aid the user in rotating adjustment knob member 22, it is preferable that outer surface 26 include a textured pattern 76 to provide a frictional surface character.

The apparatus of the present invention can be fabricated from plastic or the like, but it has been found that Delrin plastics provide a preferable material composition which achieves all the requirements of the present invention.

The nail gun head elevating tool 10 of the present invention can be adapted to any conceivable length or shape of nail 50, and is only limited by the practical requirements of the invention. Accordingly, it will be seen that this invention provides a nail gun head elevating tool 10 which allows a user to vary the penetration depth of a nail 50 being driven into a nailing surface. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An apparatus for adjusting the depth of penetration of a nail ejected from a nail gun, comprising:

(a) a base member, said base member including a first longitudinal slot means for allowing passage of said nail, said base member including cavity means for receiving a nail gun head;

(b) an adjustment knob member, said adjustment knob member including a second longitudinal slot means for allowing passage of said nail;

(c) means for coupling said base member to said nail gun head; and (d) rotatable coupling means for rotatably coupling said adjustment knob member to said base member and for extension and retraction of said adjustment knob member in relation to said nail gun head.

2. An apparatus as recited in claim 1, wherein said means for coupling said base member to said nail gun head includes means for preventing rotational motion of said base member in relation to said nail gun head.

3. An apparatus as recited in claim 1, wherein said means for coupling said base member to said nail gun head includes means for detaching said base member from said nail gun head.

4. An apparatus as recited in claim 1, further comprising means for limiting retraction of said adjustment knob member in relation to said base member.

5. An apparatus as recited in claim 4, wherein said rotatable coupling means comprises:

(a) a first plurality of threads, said first plurality of threads coupled to said base member; and (b) a second plurality of threads, said second plurality of threads coupled to said adjustment knob member;

(c) said first plurality of threads engaging said second plurality of threads.

6. A nail depth penetration control apparatus for a nail gun, comprising:

(a) a generally cylindrical base member, said base member including a first end, a second end and an outer surface, said base member including cavity means for receiving a nail gun head, said base member including a first longitudinal slot means for allowing passage of a nail extending between said first and second ends, said first slot means extending from said outer surface to said cavity means;

(b) a generally cylindrical adjustment knob member, said adjustment knob member including a first end, a second end, a cavity and an outer surface, said adjustment knob member including a second longitudinal slot means for allowing passage of said nail extending between said first and second ends, said second slot means extending from said outer surface to said cavity;

(c) means for coupling said base member to said nail gun head;

(c) rotatable coupling means for rotatably coupling said adjustment knob member to said base member and for extension and retraction of said adjustment knob member in relation to said nail gun head;

(d) means for limiting retraction of said adjustment knob member in relation to said base member.

7. An apparatus as recited in claim 6, wherein said rotatable coupling means comprises:

(a) a first plurality of threads extending from said outer surface of said base member; and (b) a second plurality of threads extending from said cavity of said adjustment knob member;

(c) said first plurality of threads engaging said second plurality of threads.

8. An apparatus as recited in claim 7, wherein said means for coupling said base member to said nail gun head includes means for detaching said base member from said nail gun head.

9. An apparatus as recited in claim 8, wherein said means for coupling said base member to said nail gun head further includes means for preventing rotational motion of said base member in relation to said nail gun head.

10. An apparatus for varying nail penetration depth comprising:

(a) a generally cylindrical base member, said base member including a first end, a second end and a threaded outer surface, said base member including cavity means for receiving a nail gun head, said base member including a first longitudinal slot means for allowing passage of a nail extending between said first and second ends, said first slot means extending from said threaded outer surface of said base member to said cavity means of said base member;

(b) a generally cylindrical adjustment knob member, said adjustment knob member including a first end, a second end, a threaded cavity and an outer surface, said adjustment knob member including a second longitudinal slot means for allowing passage of said nail extending between said first and second ends, said second slot means extending from said outer surface of said adjustment knob member to said threaded cavity of said adjustment knob member, said adjustment knob member rotatably coupled to said base member;

(c) means for detachably coupling said base member to said nail gun head;

(d) means for preventing rotational motion of said base member in relation to said nail gun head; and (e) means for limiting retraction of said adjustment knob member in relation to said base member.

11. An apparatus as recited in claim 10, wherein said cavity means in said base member is contoured to conform to a nail gun firing head.

12. An apparatus as recited in claim 10, wherein said cavity means in said base member is contoured to conform to a nail gun push lever.

* * * * *